US011651877B2

(12) United States Patent
Risi et al.

(10) Patent No.: US 11,651,877 B2
(45) Date of Patent: May 16, 2023

(54) SUPPORT ARRANGEMENT FOR AN ELECTRICAL PROTECTION ASSEMBLY

(71) Applicant: THE TRUSTEES FOR THE TIME BEING OF THE LIVE LINE INTERNATIONAL TRUST, Douglas (IM)

(72) Inventors: Kevin Philip Risi, Klerksdorp (ZA); Shaun Lawrence Risi, Klerksdorp (ZA); Philip Edward Lawrence Risi, Klerksdorp (ZA)

(73) Assignee: THE TRUSTEES FOR THE TIME BEING OF THE LIVE LINE INTERNATIONAL TRUST, Douglas (IM)

( * ) Notice: Subject to any disclaimer, the term of this patent is extended or adjusted under 35 U.S.C. 154(b) by 26 days.

(21) Appl. No.: 17/371,711

(22) Filed: Jul. 9, 2021

(65) Prior Publication Data

US 2022/0013258 A1 Jan. 13, 2022

(30) Foreign Application Priority Data

Jul. 10, 2020 (ZA) ..... 2020/04230

(51) Int. Cl.
*H01C 1/01* (2006.01)
*H01C 7/12* (2006.01)
*H01C 17/00* (2006.01)

(52) U.S. Cl.
CPC ..... *H01C 1/01* (2013.01); *H01C 7/12* (2013.01); *H01C 17/00* (2013.01)

(58) Field of Classification Search
CPC ..... H01C 17/00; H01C 7/12; H01C 1/01
See application file for complete search history.

(56) References Cited

U.S. PATENT DOCUMENTS 2,074,913 A * 3/1937 Johnson ..... H01H 31/127 337/180
3,038,046 A * 6/1962 Devine ..... H01H 85/44 29/897.3
4,161,012 A * 7/1979 Cunningham ..... H01T 4/08 361/127
8,345,399 B2 * 1/2013 Risi ..... H01T 4/08 361/111

(Continued)

*Primary Examiner* — Kyung S Lee
(74) *Attorney, Agent, or Firm* — Ladas & Parry LLP

(57) ABSTRACT

A support arrangement for an electrical protection assembly for connection between an electrical power supply line and electrical equipment is provided. The support arrangement comprises a first insulator body and a second insulator body extending at right angles to the first insulator body, wherein the first and second insulator bodies are integrally formed into a unitary body. In an embodiment, the second insulator body extends from a lower end of the first insulator body, so as to define a unitary L-shaped support arrangement. In one version, the support arrangement comprises an L-shaped inner support frame around which the first and second insulator bodies are molded. The L-shaped inner support frame comprises a T-shaped metal connector having a first end from which a first fibre glass support arm extends, around which the first insulator body is molded, and a second end from which a second fibre glass support arm extends, around which the second insulator body is molded.

17 Claims, 4 Drawing Sheets

(56) References Cited

U.S. PATENT DOCUMENTS

| | | | | |
|---|---|---|---|---|
| 2005/0142941 | A1* | 6/2005 | Borgstrom | H01R 13/53<br>29/858 |
| 2011/0080682 | A1* | 4/2011 | Risi | H01H 85/44<br>361/111 |
| 2016/0056004 | A1* | 2/2016 | Risi | H01H 31/006<br>337/6 |

* cited by examiner

SUPPORT ARRANGEMENT FOR AN ELECTRICAL PROTECTION ASSEMBLY

FIELD OF THE INVENTION

THIS invention relates to safety equipment in an electric power distribution system, and in particular to a support arrangement for an electrical protection assembly.

BACKGROUND TO THE INVENTION

ARIPO patent no. 2675 provides an electrical protection assembly for connection between an electrical power supply line and electrical equipment. There are several components that are common to the assembly in the prior art ARIPO patent and the assembly 10 of the present invention, as shown in FIG. 1. Thus, for the sake of clarity, similar reference numerals will be used for similar components. The prior art assembly comprises a central support arrangement 12 comprising a first, substantially straight, insulator support arm 14, which carries a plurality of circular sheds or skirts 15 (as is well known in the art). A fuse cutout assembly 16 comprising a fuse tube 18 extends on one side of the support arrangement 12, and on the other side there is a surge protection assembly 20 comprising a drop out voltage surge protection unit 22.

The fuse tube 18 is held between the end of a first upper, displaceable arm 24 and a second lower support arm 26 that is spaced from the upper arm 24. The lower support arm 26 also carries a plurality of circular sheds or skirts 27. The lower support arm 26 has a first bracket 28 at its free end, fitted with a connector 30, with the lower end of the fuse tube 18 being connected thereto, in use, in a pivotal manner, as is known in the art. A hood assembly 32 is attached to a first free end of the upper arm 24 to be displaceable relative thereto. The hood assembly 32 is connectable to the upper end of the fuse tube 18, and is movable away from the connector 30 upon fusing of the fuse tube 18, to ultimately allow the fuse tube 18 to detach, by pivoting away, from the fuse cutout assembly 16 (and thus the larger assembly 10 itself).

Significantly, in the prior art, the first insulator support arm 14 and the lower support arm 26 are separately fitted to a rectangular bracket. This generally works reasonably well but it does have a number of shortcomings that the present invention aims to address, namely it requires a number of separate parts and it also requires that these parts are correctly fitted together.

In addition, when the voltage surge protection unit 22 pivotally drops out (which it is designed to do in a well-known manner), this action is uncontrolled and may sometimes cause damage to the assembly 10. It is thus a further advantage of the present invention to provide a buffer plate to soften the impact of the surge protection unit 22 as it drops out.

SUMMARY OF THE INVENTION

According to a first aspect of the invention there is provided a support arrangement for an electrical protection assembly for connection between an electrical power supply line and electrical equipment, the support arrangement comprising:

a first, substantially straight, insulator body; and a second, substantially straight, insulator body extending transversely to, and thus away from, the first insulator body, wherein the first and second insulator bodies are integrally formed into a unitary body.

In an embodiment, the second insulator body extends from a lower end of the first insulator body, at right angles thereto, so as to define a unitary L-shaped support arrangement.

In an embodiment, a displaceable upper arm extends across the top of the support arrangement, with a fuse cutout assembly comprising a fuse tube extending on the side of the support arrangement with the second insulator body, and on the other side of the support arrangement there is a surge protection assembly comprising a drop out voltage surge protection unit.

A fuse cutout assembly is typically used to protect distribution transformers from current surges and overloads. When an overcurrent is caused by a fault in the transformer, for example, a fuse within a fuse tube melts. The melting results in the fuse tube detaching from the fuse cutout assembly, which in turn disconnects the transformer from the line.

In an embodiment, the upper end of the fuse tube is releasably fitted to a first end of the displaceable upper arm, with the distal end of the second insulator body including a first bracket with a connector at its free end to accommodate the lower end of the fuse tube, in use, in a pivotal manner, as is known in the art.

In one version, an elongate, flexible, resilient fuse buffer plate is fitted to, so as to extend below, the first bracket to buffer, in a controlled manner, the fuse tube as it pivotally drops out.

In an embodiment, the upper end of the drop out voltage surge protection unit is releasably fitted to a second end of the displaceable upper arm, with the lower end of the support arrangement, opposite the second insulator body, including a second bracket with a connector at its free end to accommodate the lower end of the drop out voltage surge protection unit, in use, in a pivotal manner, as is known in the art.

In one version, an elongate, flexible, resilient surge buffer plate is fitted to the second bracket to buffer, in a controlled manner, the voltage surge protection unit as it pivotally drops out.

In an embodiment, the second insulator body includes first mounting holes for receiving bolts for securing the first bracket.

In an embodiment, the first insulator body includes second mounting holes for receiving bolts for securing the second bracket.

In an embodiment, the first insulator body includes a third mounting hole at its lower end for receiving a bolt for securing a third bracket.

In an embodiment, the first insulator body includes fourth mounting holes for receiving bolts for securing a support arm strut to an upper end of the first insulator body.

In an embodiment, the support arrangement comprises an L-shaped inner support frame around which the first and second insulator bodies are (injection) molded.

The L-shaped inner support frame comprises a T-shaped metal connector having a first end from which a first fibre glass support arm (or rod) extends, around which the first insulator body can be molded, and a second end from which a second fibre glass support arm or rod) extends, around which the second insulator body can be molded. A third end of the T-shaped metal connector defines the bottom of the support arrangement, with the third mounting hole being defined within the third end of the T-shaped metal connector.

In an embodiment, the T-shaped metal connector includes a mounting formation, opposite the second end of the T-shaped metal connector, in which the second mounting holes for receiving bolts for securing the second bracket are defined.

In an embodiment, the end of the second fibre glass support arm is fitted with a first metal connector, in which the first mounting holes for receiving bolts for securing the first bracket are defined. The first metal connector is slightly enlarged relative to the second fibre glass support arm.

In an embodiment, the end of the first fibre glass support arm is fitted with a second metal connector, in which the fourth mounting holes for receiving bolts for securing the support arm strut are defined. The second metal connector is slightly enlarged relative to the first fibre glass support arm.

In an embodiment, the first and second insulator bodies each carry a plurality of sheds or skirts. In one version, a shed on the first insulator body, typically a shed proximate a lower region of the first insulator body, is joined to a proximate shed on the second insulator body (to provide support and for aesthetic purposes).

According to a second aspect of the invention, there is provided a method of manufacturing a support arrangement for an electrical protection assembly, the method comprising:

providing an L-shaped inner support frame, and injection molding, under pressure using a suitable polymer, an insulator body along and around the L-shaped support frame, so as to ultimately define a support arrangement comprising a first, substantially straight, insulator body and a second, substantially straight, insulator body extending transversely to, and thus away from, the first insulator body, wherein the first and second insulator bodies are integrally formed into a unitary L-shaped support arrangement.

In an embodiment, the step of providing an L-shaped inner support frame comprises the steps of:

providing a T-shaped metal connector having a first end and a second end at right angles to the first end;

inserting a first end of a first fibre glass support arm (or rod) into the first end of the T-shaped metal connector, around which the first insulator body can be molded;

inserting a second end of a second fibre glass support arm (or rod) into the second end of the T-shaped metal connector, around which the second insulator body can be molded;

fitting a first metal connector to a second end of the second fibre glass support arm, in which first mounting holes are defined for receiving bolts for securing a first bracket; and fitting a second metal connector to a second end of the first fibre glass support arm, in which mounting holes are defined for receiving bolts for securing a support arm strut.

In an embodiment, a third end of the T-shaped metal connector defines the bottom of the support arrangement, with a mounting hole being defined within the third end of the T-shaped metal connector.

In an embodiment, the method comprises fitting or providing a mounting formation to the T-shaped metal connector, opposite the second end of the T-shaped metal connector, in which mounting holes are defined for receiving bolts for securing a second bracket.

DETAILED DESCRIPTION OF THE DRAWINGS

Figure 1:
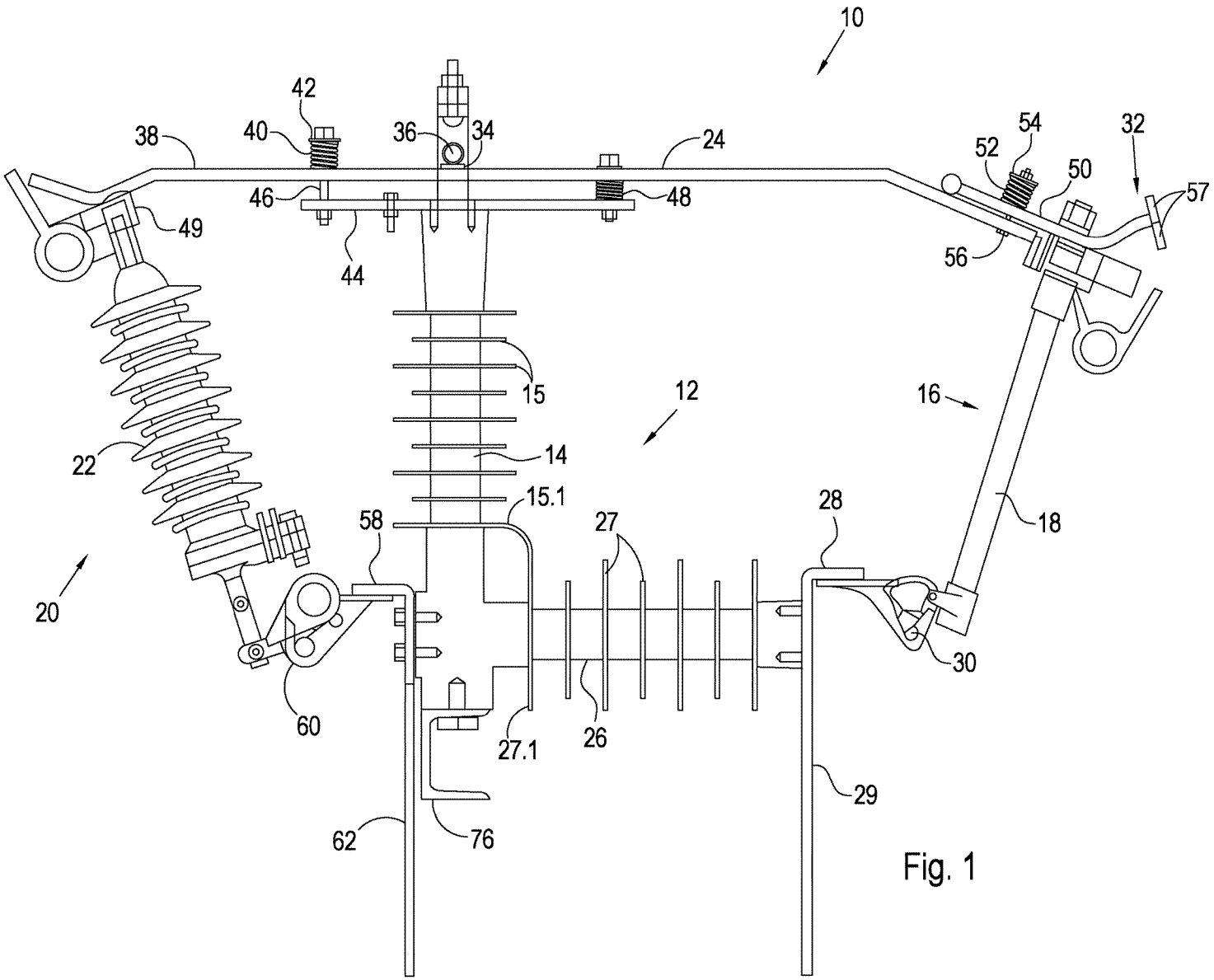
FIG. 1 shows a side view of an electrical protection assembly with an L-shaped support arrangement according to a first aspect of the invention.

The bulk of the assembly has already been described above. In addition to the components described above, a mounting bracket 34 is fitted to the central portion of the upper arm 24. The bracket 34 is pivotally mounted to the upper end of the central support arrangement 12 by a pivot pin 36.

The upper arm 24 extends beyond the mounting bracket 34 and the central support arrangement 12 to have a portion 38 on the opposite side of the central support arrangement 12 to the hood assembly 32, by means of which the voltage surge protection unit 22 is mounted. The portion 38 is urged in an anticlockwise direction by means of a first urging element, in the form of a compression spring 40, acting against a stop washer 42 secured to an underlying support arm strut 44 by means of a bolt 46. The spring 40 is positioned on the voltage surge protection unit side and acts on the portion 38 of the upper arm 24.

The support arm strut 44 extends to the fusible device side of the central support arrangement 12 and carries a second spring 48 that also acts on the upper arm 24 to displace it in an anticlockwise direction together with the spring 40. It will be appreciated that, in use, when the voltage surge protection unit 22 drops out (with the upper end of the unit 22 dislodging from a holder 49 at the end of the upper arm portion 38, in a known manner), the upper arm 24 is caused to pivot to release the fuse tube 18 to allow it to drop out as well.

It will be appreciated further that when the voltage surge protection unit 22 is engaged with the portion 38 the upper arm 24 is effectively fixed in position and an auxiliary arm 50 of the hood assembly 32 then moves independently relative thereto. However, when the voltage surge protection unit 22 drops out, the auxiliary arm 50 and the upper arm 24 then move together under the action of the springs 40 and 48.

A further urging element, in the form of a compression spring 52, is provided for urging the hood assembly 32 towards the connector 30. The spring 52 acts on a stop washer 54 secured to the upper arm 24 by a bolt 56. It will be seen that the spring 52 urges the auxiliary arm 50 in a clockwise direction.

The auxiliary arm 50 is configured such that the hood assembly 32 is disposed substantially transversely to the fuse tube 18, such that, when the fuse tube 18 fuses, in use, a perpendicular thrust is exerted on the hood assembly 32. As shown, the hood assembly 32 is further from the first insulator support arm 14 than the connector 30. Thus, if the first insulator support arm 14 is vertically mounted, as shown, which is normally the case, the fuse tube 18 is outwardly angled. Thus, in use, upon fusing of the fuse tube 18, it pivots in a clockwise direction, in a known manner, about the connector 30.

In addition, an elongate, flexible, resilient fuse buffer plate 29, typically extending vertically downwardly, is fitted to the first bracket 28 to buffer, in a controlled manner, the fuse tube 18 as it pivotally drops out.

The lower end of the central support arrangement 12, on the surge protection side 20 of the assembly 10, has a second bracket 58 fitted with a connector 80, with the lower end of the surge protection unit 22 being connected thereto, in use, in a pivotal manner, as is known in the art.

In addition, an elongate, flexible, resilient surge buffer plate 62, typically extending vertically downwardly, is fitted to the second bracket 58 to buffer, in a controlled manner, the voltage surge protection unit 22 as it pivotally drops out.

Horns 57 are fitted to the hood assembly 32, which can either be lifted up, which would in turn cause the fuse tube 18 to pivot away, or pushed down, which would in turn cause the surge protection unit 22 to pivot away, as described in more detail further below.

Figure 2:
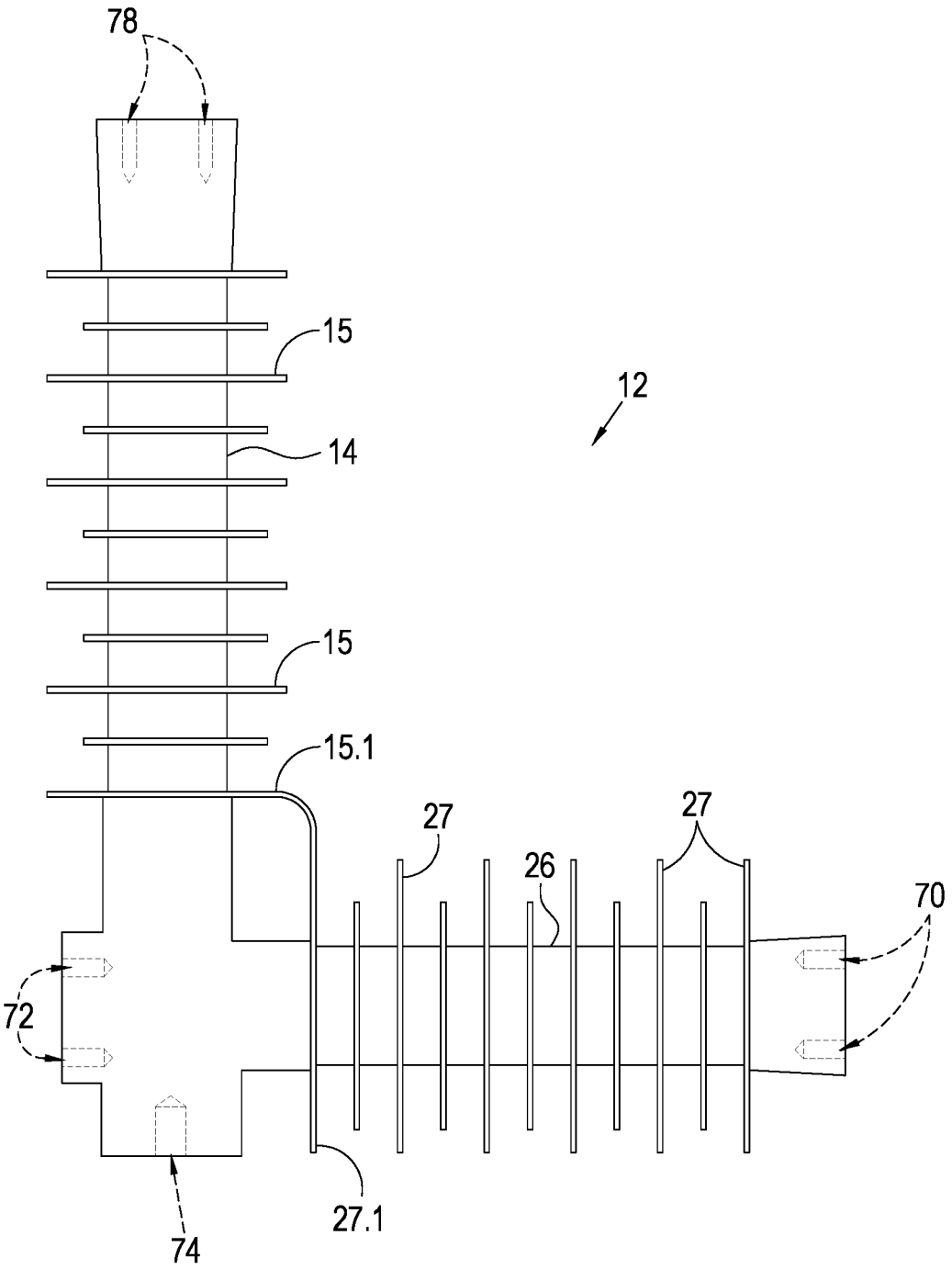
FIG. 2 shows a side view of the L-shaped support arrangement of the present invention, the L-shaped support arrangement comprising a first, vertically extending, insulator body, and a second, horizontally extending, second insulator body extending from a lower end of the first insulator body.

Turning now specifically to the present invention, with reference to FIG. 2 as well, the support arrangement 12 of the present invention comprises a first, substantially straight, insulator body 14 and a second, substantially straight, insulator body 26 extending transversely to, and thus away from, the first insulator body 14, substantially at right angles. Significantly, the first and second insulator bodies 14, 26 are integrally formed into a unitary body, to address the disadvantages set out above.

Turning now to FIG. 2 in particular, the second insulator body 26 includes first mounting holes 70 for receiving bolts for securing the first bracket 28. The central support arrangement 12 further includes second mounting holes 72 for receiving bolts for securing the second bracket 58. The central support arrangement 12 further includes a third mounting hole 74 for receiving a bolt for securing the bracket 76. The central support arrangement 12 further includes fourth mounting holes 78 for receiving bolts for securing the support arm strut 44 to the first insulator body 14.

Figure 3:
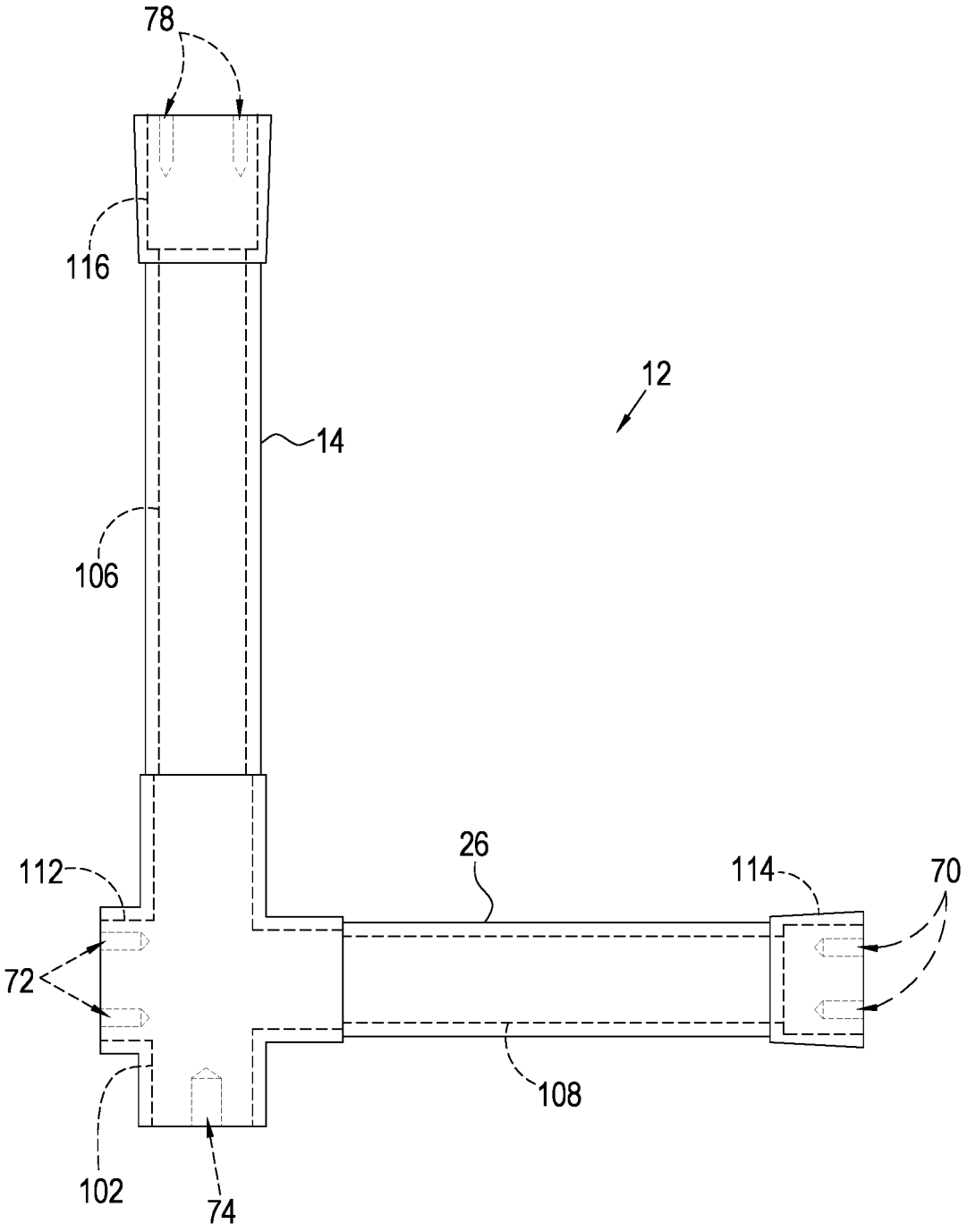
FIG. 3 shows a side view similar to FIG. 2, and related views, but with an L-shaped inner support frame being shown in dotted outline relative to the L-shaped support arrangement (and with the sheds on the first and second insulator bodies being removed for clarity)
Figure 4:
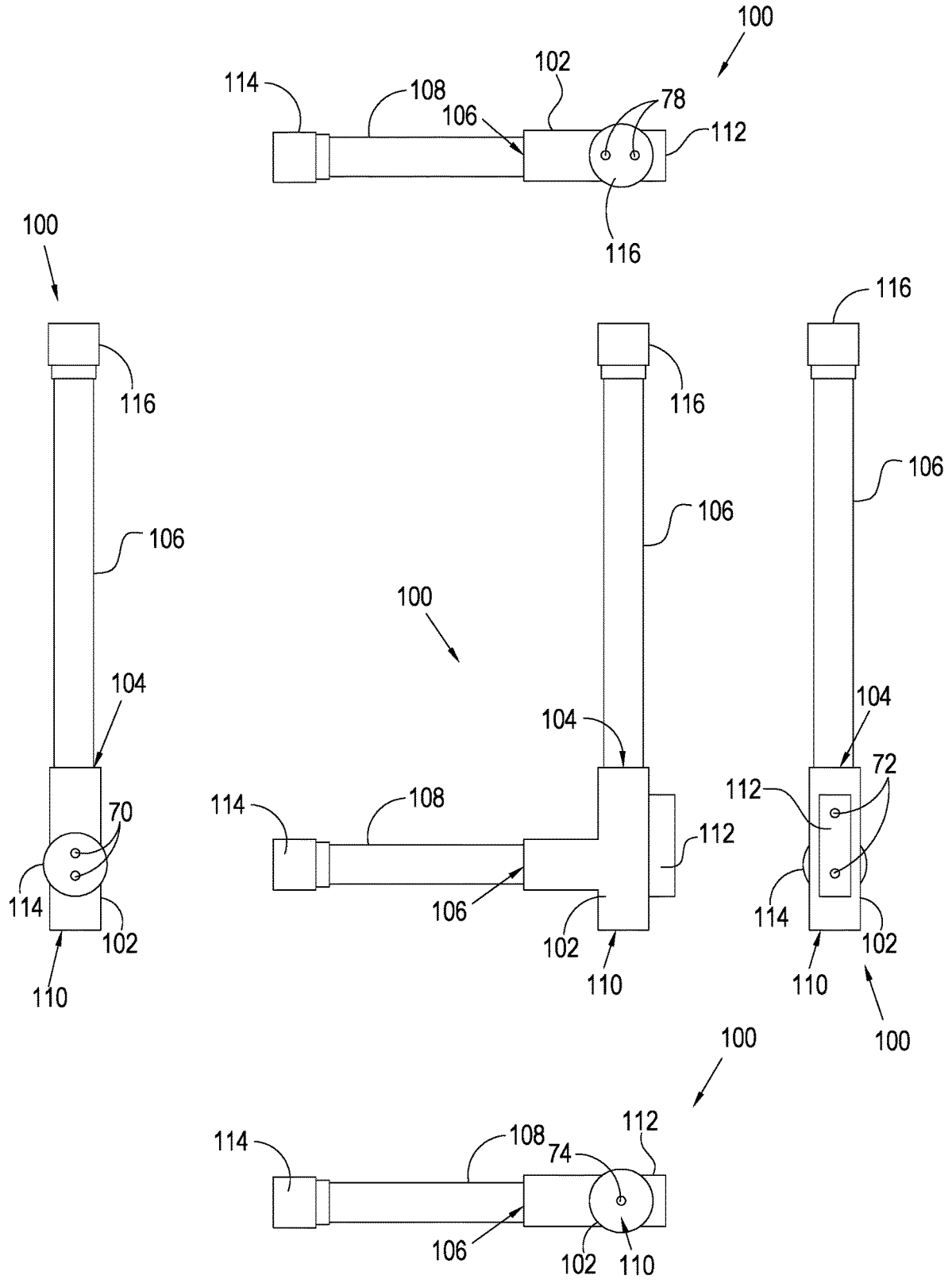
FIG. 4 shows a side view of the L-shaped inner support frame by itself as a separate component.

Turning now to FIGS. 3 and 4, the support arrangement 12 comprises an L-shaped inner support frame 100 around which the first and second insulator bodies 14, 26 are (injection) molded.

The L-shaped inner support frame 100 comprises a T-shaped metal connector 102 having a first end 104 from which a first fibre glass support arm (or rod) 106 extends, around which the first insulator body 14 can be molded. The T-shaped metal connector 102 further includes a second end 106 from which a second fibre glass support arm (or rod) 108 extends, around which the second insulator body 26 can be molded.

A third end 110 of the T-shaped metal connector 102 defines the bottom of the support arrangement 12, with the third mounting hole 74 being defined within the third end of the T-shaped metal connector 102.

In an embodiment, the T-shaped metal connector 102 includes a mounting formation 112, opposite the second end 106 of the T-shaped metal connector 102, in which the second mounting holes 72 for receiving bolts for securing the second bracket 58 are defined.

In an embodiment, the end of the second fibre glass support arm 108 is fitted with a first metal connector 114, in which the first mounting holes 70 for receiving bolts for securing the first bracket 28 are defined. The first metal connector 114 is slightly enlarged relative to the second fibre glass support arm 108.

In an embodiment, the end of the first fibre glass support arm 106 is fitted with a second metal connector 116, in which the fourth mounting holes 78 for receiving bolts for securing the support arm strut 44 are defined. The second metal connector 116 is slightly enlarged relative to the first fibre glass support arm 106.

In an embodiment, the first and second insulator bodies 14, 26 each carry a plurality of sheds or skirts 15, 27, respectively. In one version, a shed 15.1 on the first insulator body 14, typically a shed proximate a lower region of the first insulator body 14, is joined to a proximate shed 27.1 on the second insulator body 27, to provide support and for aesthetic purposes.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A support arrangement for an electrical protection assembly for connection between an electrical power supply line and electrical equipment, the support arrangement comprising:

a first, substantially straight, insulator body;

a second, substantially straight, insulator body extending transversely to, and thus away from, the first insulator body, wherein the first and second insulator bodies are integrally formed into a unitary body; and an L-shaped inner support frame around which the first and second insulator bodies are molded, wherein the L-shaped inner support frame comprises a T-shaped metal connector having a first end from which a first fibre glass support arm extends, around which the first insulator body is molded, and a second end from which a second fibre glass support arm extends, around which the second insulator body is molded.

2. The support arrangement of claim 1, wherein the second insulator body extends from a lower end of the first insulator body, at right angles thereto, so as to define a unitary L-shaped support arrangement.

3. The support arrangement of claim 1, wherein a displaceable upper arm extends across the top of the support arrangement, with a fuse cutout assembly comprising a fuse tube extending on the side of the support arrangement with the second insulator body, and on the other side of the support arrangement there is a surge protection assembly comprising a drop out voltage surge protection unit.

4. The support arrangement of claim 3, wherein the upper end of the fuse tube is releasably fitted to a first end of the displaceable upper arm, with the distal end of the second insulator body including a first bracket with a connector at its free end to accommodate the lower end of the fuse tube, in use, in a pivotal manner.

5. The support arrangement of claim 4, wherein an elongate, flexible, resilient fuse buffer plate is fitted to, so as to extend below, the first bracket to buffer, in a controlled manner, the fuse tube as it pivotally drops out.

6. The support arrangement of claim 4, wherein the upper end of the drop out voltage surge protection unit is releasably fitted to a second end of the displaceable upper arm, with the lower end of the support arrangement, opposite the second insulator body, including a second bracket with a connector at its free end to accommodate the lower end of the drop out voltage surge protection unit, in use, in a pivotal manner.

7. The support arrangement of claim 6, wherein an elongate, flexible, resilient surge buffer plate is fitted to the second bracket to buffer, in a controlled manner, the voltage surge protection unit as it pivotally drops out.

8. The support arrangement of claim 6, wherein the second insulator body includes first mounting holes for receiving bolts for securing the first bracket.

9. The support arrangement of claim 8, wherein the first insulator body includes:

second mounting holes for receiving bolts for securing the second bracket;

a third mounting hole at its lower end for receiving a bolt for securing a third bracket; and fourth mounting holes for receiving bolts for securing a support arm strut to an upper end of the first insulator body.

10. The support arrangement of claim 9, wherein a third end of the T-shaped metal connector defines the bottom of the support arrangement, with the third mounting hole being defined within the third end of the T-shaped metal connector.

11. The support arrangement of claim 10, wherein the T-shaped metal connector includes a mounting formation, opposite the second end of the T-shaped metal connector, in which the second mounting holes for receiving bolts for securing the second bracket are defined.

12. The support arrangement of claim 11, wherein the end of the second fibre glass support arm is fitted with a first metal connector, in which the first mounting holes for receiving bolts for securing the first bracket are defined.

13. The support arrangement of claim 12, wherein the end of the first fibre glass support arm is fitted with a second metal connector, in which the fourth mounting holes for receiving bolts for securing the support arm strut are defined.

14. The support arrangement of claim 1, wherein the first and second insulator bodies each carry a plurality of sheds or skirts, with a shed on the first insulator body being joined to a proximate shed on the second insulator body to provide support.

15. A method of manufacturing a support arrangement for an electrical protection assembly, the method comprising:

providing an L-shaped inner support frame; and molding an insulator body along and around the L-shaped support frame, so as to ultimately define a support arrangement comprising a first, substantially straight, insulator body and a second, substantially straight, insulator body extending transversely to, and thus away from, the first insulator body, wherein the first and second insulator bodies are integrally formed into a unitary L-shaped support arrangement, wherein the step of providing an L-shaped inner support frame comprises the steps of:

providing a T-shaped metal connector having a first end and a second end at right angles to the first end;

inserting a first end of a first fibre glass support arm into the first end of the T-shaped metal connector, around which the first insulator body can be molded;

inserting a second end of a second fibre glass support arm into the second end of the T-shaped metal connector, around which the second insulator body can be molded;

fitting a first metal connector to a second end of the second fibre glass support arm, in which first mounting holes are defined for receiving bolts for securing a first bracket; and fitting a second metal connector to a second end of the first fibre glass support arm, in which mounting holes are defined for receiving bolts for securing a support arm strut.

16. The method of claim 15, wherein a third end of the T-shaped metal connector defines the bottom of the support arrangement, with a mounting hole being defined within the third end of the T-shaped metal connector.

17. The method of claim 16, wherein the method comprises fitting or providing a mounting formation to the T-shaped metal connector, opposite the second end of the T-shaped metal connector, in which mounting holes are defined for receiving bolts for securing a second bracket.

* * * * *